US008839587B2

(12) United States Patent
Hohmann, Jr.

(10) Patent No.: US 8,839,587 B2
(45) Date of Patent: Sep. 23, 2014

(54) MOUNTING ARRANGEMENT FOR PANEL VENEER STRUCTURES

(71) Applicant: Mitek Holdings, Inc., Wilmington, DE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 13/798,722

(22) Filed: Mar. 13, 2013

(65) Prior Publication Data

US 2014/0096466 A1 Apr. 10, 2014

Related U.S. Application Data

(60) Provisional application No. 61/610,582, filed on Mar. 14, 2012.

(51) Int. Cl.

| | |
|---|---|
| ***E04B 1/38*** | (2006.01) |
| ***E04C 5/00*** | (2006.01) |
| ***E04B 1/41*** | (2006.01) |

(52) U.S. Cl.

CPC ..... *E04B 1/4185* (2013.01)
USPC ..... 52/700; 52/509; 52/512; 52/565

(58) Field of Classification Search

USPC ..... 52/512, 509, 513, 546, 582.1, 700, 520, 52/565

See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |

(Continued)

FOREIGN PATENT DOCUMENTS

| | | | |
|---|---|---|---|
| CH | 279209 4 | b | 3/1952 |
| EP | 0199595 | B1 | 3/1995 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Brian Glessner
*Assistant Examiner* — Brian D Mattei
(74) *Attorney, Agent, or Firm* — Silber & Fridman

(57) ABSTRACT

A high-strength panel anchoring system for use in a cavity wall. A wall anchor is fixedly attached to an inner wythe. The wall anchor includes a set of pronged legs for insertion through insulation and securement against the inner wythe and a plate connecting the set of pronged legs and maintaining the legs at substantially right angles from the plate. The plate has an aperture to receive a fastener. A U-shaped separator is adjacent the wall anchor. A split veneer tie is adjacent the separator and opposite the wall anchor. The veneer tie includes a backplate having an aperture to receive a fastener and an insertion portion having a cavity end contiguous with the backplate and set at a substantially right angle thereto. The insertion portion has an insertion end having two legs set at opposite substantially right angles for interconnection with a plurality of panels forming an outer wythe.

23 Claims, 5 Drawing Sheets

(56) References Cited

U.S. PATENT DOCUMENTS

| | | | | |
|---|---|---|---|---|
| 1,170,419 | A | | 2/1916 | Coon et al. |
| RE15,979 | E | | 1/1925 | Schaefer et al. |
| 1,794,684 | A | | 3/1931 | Handel |
| 1,936,223 | A | | 11/1933 | Awbrey |
| 2,058,148 | A | | 10/1936 | Hard |
| 2,097,821 | A | | 11/1937 | Mathers |
| 2,280,647 | A | | 4/1942 | Hawes |
| 2,300,181 | A | | 10/1942 | Spaight |
| 2,403,566 | A | | 7/1946 | Thorp et al. |
| 2,413,772 | A | | 1/1947 | Morehouse |
| 2,605,867 | A | | 8/1952 | Goodwin |
| 2,780,936 | A | | 2/1957 | Hillberg |
| 2,898,758 | A | | 8/1959 | Henrickson |
| 2,929,238 | A | | 3/1960 | Kaye |
| 2,966,705 | A | | 1/1961 | Massey |
| 2,999,571 | A | | 9/1961 | Huber |
| 3,030,670 | A | | 4/1962 | Bigelow |
| 3,183,628 | A | | 5/1965 | Smith |
| 3,254,736 | A | | 6/1966 | Gass |
| 3,277,626 | A | | 10/1966 | Brynjolfsson et al. |
| 3,300,939 | A | | 1/1967 | Brynjolfsson et al. |
| 3,309,828 | A | | 3/1967 | Tribble |
| 3,310,926 | A | | 3/1967 | Brandreth et al. |
| 3,341,998 | A | | 9/1967 | Lucas |
| 3,377,764 | A | | 4/1968 | Storch |
| 3,478,480 | A | * | 11/1969 | Swenson, William E. 52/396.05 |
| 3,563,131 | A | | 2/1971 | Ridley, Sr. |
| 3,568,389 | A | | 3/1971 | Gulow |
| 3,640,043 | A | | 2/1972 | Querfeld et al. |
| 3,964,226 | A | | 6/1976 | Hala et al. |
| 3,964,227 | A | | 6/1976 | Hala |
| 4,021,990 | A | | 5/1977 | Schwalberg |
| 4,227,359 | A | | 10/1980 | Schlenker |
| 4,238,987 | A | | 12/1980 | Siebrecht-Reuter |
| 4,305,239 | A | | 12/1981 | Geraghty |
| 4,373,314 | A | | 2/1983 | Allan |
| 4,382,416 | A | | 5/1983 | Kellogg-Smith |
| 4,424,745 | A | | 1/1984 | Magorian et al. |
| 4,438,611 | A | | 3/1984 | Bryant |
| 4,473,984 | A | | 10/1984 | Lopez |
| 4,482,368 | A | | 11/1984 | Roberts |
| 4,571,909 | A | | 2/1986 | Berghuis et al. |
| 4,596,102 | A | | 6/1986 | Catani et al. |
| 4,598,518 | A | | 7/1986 | Hohmann |
| 4,606,163 | A | | 8/1986 | Catani |
| 4,622,796 | A | | 11/1986 | Aziz et al. |
| 4,628,657 | A | * | 12/1986 | Ermer et al. ..... 52/509 |
| 4,636,125 | A | | 1/1987 | Burgard |
| 4,640,848 | A | | 2/1987 | Cerdan-Diaz et al. |
| 4,660,342 | A | | 4/1987 | Salisbury |
| 4,703,604 | A | | 11/1987 | Muller |
| 4,708,551 | A | | 11/1987 | Richter et al. |
| 4,738,070 | A | | 4/1988 | Abbott et al. |
| 4,764,069 | A | | 8/1988 | Reinwall et al. |
| 4,819,401 | A | | 4/1989 | Whitney, Jr. |
| 4,827,684 | A | | 5/1989 | Allan |
| 4,843,776 | A | | 7/1989 | Guignard |
| 4,852,320 | A | | 8/1989 | Ballantyne |
| 4,869,038 | A | | 9/1989 | Catani |
| 4,869,043 | A | | 9/1989 | Hatzinikolas et al. |
| 4,875,319 | A | | 10/1989 | Hohmann |
| 4,911,949 | A | | 3/1990 | Iwase et al. |
| 4,922,680 | A | | 5/1990 | Kramer |
| 4,946,632 | A | | 8/1990 | Pollina |
| 4,955,172 | A | | 9/1990 | Pierson |
| 5,063,722 | A | | 11/1991 | Hohmann |
| 5,099,628 | A | | 3/1992 | Noland et al. |
| 5,207,043 | A | | 5/1993 | McGee et al. |
| 5,307,602 | A | | 5/1994 | Lebraut |
| 5,392,581 | A | | 2/1995 | Hatzinikolas et al. |
| 5,408,798 | A | | 4/1995 | Hohmann |
| 5,440,854 | A | | 8/1995 | Hohmann |
| 5,454,200 | A | | 10/1995 | Hohmann |
| 5,456,052 | A | | 10/1995 | Anderson et al. |
| 5,490,366 | A | | 2/1996 | Burns et al. |
| 5,598,673 | A | | 2/1997 | Atkins |
| 5,634,310 | A | | 6/1997 | Hohmann |
| 5,669,592 | A | | 9/1997 | Kearful |
| 5,671,578 | A | | 9/1997 | Hohmann |
| 5,673,527 | A | | 10/1997 | Coston et al. |
| 5,755,070 | A | | 5/1998 | Hohmann |
| 5,816,008 | A | | 10/1998 | Hohmann |
| 5,819,486 | A | | 10/1998 | Goodings |
| 5,845,455 | A | | 12/1998 | Johnson, III |
| 6,000,178 | A | | 12/1999 | Goodings |
| 6,125,608 | A | | 10/2000 | Charlson |
| 6,209,281 | B1 | | 4/2001 | Rice |
| 6,279,283 | B1 | | 8/2001 | Hohmann et al. |
| 6,284,311 | B1 | | 9/2001 | Gregorovich et al. |
| 6,332,300 | B1 | | 12/2001 | Wakai |
| 6,351,922 | B1 | | 3/2002 | Burns et al. |
| 6,367,219 | B1 | | 4/2002 | Quinlan |
| 6,612,343 | B2 | | 9/2003 | Camberlin et al. |
| 6,627,128 | B1 | | 9/2003 | Boyer |
| 6,668,505 | B1 | | 12/2003 | Hohmann et al. |
| 6,686,301 | B2 | | 2/2004 | Li et al. |
| 6,735,915 | B1 | | 5/2004 | Johnson, III |
| 6,739,105 | B2 | | 5/2004 | Fleming |
| 6,789,365 | B1 | | 9/2004 | Hohmann et al. |
| 6,817,147 | B1 | | 11/2004 | MacDonald |
| 6,827,969 | B1 | | 12/2004 | Skoog et al. |
| 6,837,013 | B2 | | 1/2005 | Foderberg et al. |
| 6,851,239 | B1 | | 2/2005 | Hohmann et al. |
| 6,925,768 | B2 | | 8/2005 | Hohmann et al. |
| 6,941,717 | B2 | | 9/2005 | Hohmann et al. |
| 6,968,659 | B2 | | 11/2005 | Boyer |
| 7,007,433 | B2 | | 3/2006 | Boyer |
| 7,017,318 | B1 | | 3/2006 | Hohmann et al. |
| 7,043,884 | B2 | | 5/2006 | Moreno |
| 7,059,577 | B1 | | 6/2006 | Burgett |
| D527,834 | S | | 9/2006 | Thimons et al. |
| 7,147,419 | B2 | | 12/2006 | Balbo Di Vinadio |
| 7,152,382 | B2 | | 12/2006 | Johnson, III |
| 7,171,788 | B2 | | 2/2007 | Bronner |
| 7,178,299 | B2 | | 2/2007 | Hyde et al. |
| D538,948 | S | | 3/2007 | Thimons et al. |
| 7,225,590 | B1 | | 6/2007 | diGirolamo et al. |
| 7,325,366 | B1 | | 2/2008 | Hohmann, Jr. et al. |
| 7,334,374 | B2 | | 2/2008 | Schmid |
| 7,374,825 | B2 | | 5/2008 | Hazel et al. |
| 7,415,803 | B2 | | 8/2008 | Bronner |
| 7,469,511 | B2 | | 12/2008 | Wobber |
| 7,481,032 | B2 | | 1/2009 | Tarr |
| 7,552,566 | B2 | | 6/2009 | Hyde et al. |
| 7,562,506 | B2 | | 7/2009 | Hohmann, Jr. |
| 7,587,874 | B2 | | 9/2009 | Hohmann, Jr. |
| 7,735,292 | B2 | | 6/2010 | Massie |
| 7,748,181 | B1 | | 7/2010 | Guinn |
| 7,788,869 | B2 | * | 9/2010 | Voegele, Jr. ..... 52/461 |
| D626,817 | S | | 11/2010 | Donowho et al. |
| 7,845,137 | B2 | | 12/2010 | Hohmann, Jr. |
| 8,037,653 | B2 | | 10/2011 | Hohmann, Jr. |
| 8,051,619 | B2 | | 11/2011 | Hohmann, Jr. |
| 8,096,090 | B1 | | 1/2012 | Hohmann, Jr. et al. |
| 8,109,706 | B2 | | 2/2012 | Richards |
| 8,122,663 | B1 | | 2/2012 | Hohmann, Jr. et al. |
| 8,201,374 | B2 | | 6/2012 | Hohmann, Jr. |
| 8,209,934 | B2 | | 7/2012 | Pettingale |
| 8,215,083 | B2 | | 7/2012 | Toas et al. |
| 8,291,672 | B2 | | 10/2012 | Hohmann, Jr. et al. |
| 8,347,581 | B2 | | 1/2013 | Doerr et al. |
| 8,375,667 | B2 | | 2/2013 | Hohmann, Jr. |
| 8,418,422 | B2 | | 4/2013 | Johnson, III |
| 8,511,041 | B2 | | 8/2013 | Fransen |
| 8,516,763 | B2 | | 8/2013 | Hohmann, Jr. |
| 8,516,768 | B2 | | 8/2013 | Johnson, III |
| 8,544,228 | B2 | | 10/2013 | Bronner |
| 8,555,587 | B2 | | 10/2013 | Hohmann, Jr. |
| 8,555,596 | B2 | | 10/2013 | Hohmann, Jr. |
| 8,596,010 | B2 | | 12/2013 | Hohmann, Jr. |
| 8,613,175 | B2 | | 12/2013 | Hohmann, Jr. |
| 8,667,757 | B1 | | 3/2014 | Hohmann, Jr. |
| 2001/0054270 | A1 | | 12/2001 | Rice |
| 2002/0100239 | A1 | | 8/2002 | Lopez |

(56) References Cited

U.S. PATENT DOCUMENTS

| | | | | |
|---|---|---|---|---|
| 2003/0121226 | A1* | 7/2003 | Bolduc | 52/391 |
| 2003/0217521 | A1 | 11/2003 | Richardson et al. | |
| 2004/0231270 | A1 | 11/2004 | Collins et al. | |
| 2005/0279043 | A1 | 12/2005 | Bronner | |
| 2006/0198717 | A1 | 9/2006 | Fuest | |
| 2006/0242921 | A1 | 11/2006 | Massie | |
| 2006/0251916 | A1 | 11/2006 | Arikawa et al. | |
| 2008/0222992 | A1* | 9/2008 | Hikai et al. | 52/700 |
| 2009/0133351 | A1 | 5/2009 | Wobber | |
| 2009/0133357 | A1 | 5/2009 | Richards | |
| 2010/0037552 | A1 | 2/2010 | Bronner | |
| 2010/0101175 | A1 | 4/2010 | Hohmann | |
| 2010/0192495 | A1* | 8/2010 | Huff et al. | 52/302.1 |
| 2011/0023748 | A1 | 2/2011 | Wagh et al. | |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2012/0186183 | A1 | 7/2012 | Johnson, III | |
| 2013/0008121 | A1 | 1/2013 | Dalen | |
| 2013/0074435 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247482 | A1 | 9/2013 | Hohmann, Jr. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2014/0000211 | A1 | 1/2014 | Hohmann, Jr. | |

FOREIGN PATENT DOCUMENTS

| | | |
|---|---|---|
| GB | 1575501 | 9/1980 |
| GB | 2069024 A | 8/1981 |
| GB | 2246149 A | 1/1992 |
| GB | 2265164 A | 9/1993 |
| GB | 2459936 B | 3/2013 |

OTHER PUBLICATIONS

ASTM Standard Specification A951/A951M—11, Table 1, Standard Specification for Steel Wire for Masonry Joint Reinforcement, Nov. 14, 2011, 6 pages, West Conshohocken, Pennsylvania, United States.

Building Code Requirements for Masonry Structures and Commentary, TMS 402-1/ACI 530-11/ASCE 5-11, 2011, Chapter 6, 12 pages.

Hohmann & Barnard, Inc., Product Catalog 2003, 44 pages, Hauppauge, New York, United States.

Hohmann & Barnard, Inc., Product Catalog, 2009, 52 pages, Hauppauge, New York, United States.

Hohmann & Barnard, Inc., Product Catalog, 2013, 52 pages, Hauppauge, New York, United States.

Kossecka, Ph.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

State Board of Building Regulations and Standards, Building Envelope Requirements, 780 CMR sec. 1304.0 et seq., 7th Edition, Aug. 22, 2008, 11 pages, Boston, MA, United States.

* cited by examiner

MOUNTING ARRANGEMENT FOR PANEL VENEER STRUCTURES

BACKGROUND OF THE INVENTION

This invention provides a mounting arrangement for surface mounted panel veneers on the inner wythe of an insulated cavity wall. The mounting arrangement is affixed to the inner wythe with a fastener and stabilized with a mounting bracket and contoured shim. The panel veneers are interlocked and interconnected to the inner wythe by a configured sheetmetal veneer tie.

SUMMARY

A high-strength panel anchoring system can be used in a cavity wall having a wallboard inner wythe and insulation thereon and an outer wythe in a spaced apart relationship the one with the other and having a cavity therebetween. The outer wythe is formed from a plurality of panels. In one aspect of the present invention, the anchoring system generally comprises a wall anchor that can be fixedly attached to the inner wythe. The wall anchor further comprises a set of pronged legs for insertion through the insulation and securement against the inner wythe. A plate connects the set of pronged legs and maintains the legs at substantially right angles from the plate, which has an aperture to receive a fastener. A separator adjacent the wall anchor is substantially U-shaped. A split veneer tie adjacent the separator and opposite the wall anchor comprises a backplate having an aperture to receive a fastener, an insertion portion having a cavity end contiguous with the backplate and set at a substantially right angle from the backplate and an insertion end for interconnection with the panels. The insertion end has two legs set at opposite substantially right angles from the cavity end and dimensioned for interconnection with the panels. A fastener can be interconnected with the inner wythe.

A high-strength panel anchoring system of the type set forth in the preceding paragraph can have a cavity in excess of four inches between the inner and outer wythes. In another aspect of the present invention, the anchoring system generally comprises a sheetmetal wall anchor capable of being fixedly attached to said inner wythe. The wall anchor further comprises a set of pronged legs for insertion through said insulation and securement against said inner wythe. A plate connects the set of pronged legs and maintains the legs at substantially right angles from the plate. The plate has an aperture to receive a fastener that is an elongated slot. A separator adjacent said wall anchor is substantially U-shaped. A split sheetmetal veneer tie adjacent the separator and opposite said wall anchor further comprises a backplate having an aperture to receive a fastener, an insertion portion having a cavity end contiguous with the backplate and set at a substantially right angle from the backplate and an insertion end for interconnection with the panels. The insertion end has two legs set at opposite substantially right angles from the cavity end and dimensioned for interconnection with the panels. The veneer tie is dimensioned to limit movement of the outer wythe. A fastener can interconnect with the inner wythe.

A high-strength panel anchoring system can be used in a cavity wall having a masonry inner wythe and insulation thereon and an outer wythe in a spaced apart relationship the one with the other and having a cavity therebetween. The outer wythe is formed from a plurality of panels. In yet another aspect of the present invention, the anchoring system generally comprises a folded sheetmetal wall anchor for fixedly attaching to the inner wythe. The wall anchor further comprises a first pronged leg for insertion through the insulation and securement against the inner wythe, and a second pronged leg for insertion through the insulation and securement against the inner wythe. The second pronged leg is substantially parallel to the first pronged leg. An apertured plate set at a substantially right angle from the first pronged leg and the second pronged leg joins the first pronged leg and the second pronged leg. The aperture is an elongated slot. A thermally-isolating separator set adjacent the wall anchor is substantially U-shaped and dimensioned to straddle the aperture. A split sheetmetal veneer tie is adjacent the separator and opposite the wall anchor. The veneer tie further comprises a backplate having an aperture to receive a fastener, an insertion portion having a cavity end contiguous with the backplate and set at a substantially right angle from the backplate and an insertion end for interconnection with the panel. The insertion end has two legs set at opposite substantially right angles from the cavity end and dimensioned for interconnection with the panels. The veneer tie is dimensioned to limit movement of the outer wythe. A fastener can be used for interconnection with the inner wythe.

BRIEF DESCRIPTION OF THE DRAWINGS

In the following drawings, the same parts in the various views are afforded the same reference designators.

DESCRIPTION OF THE PREFERRED EMBODIMENT

In the embodiments described herein below, the inner wythe is provided with insulation. In the dry wall, wallboard or masonry construction, this takes the form of exterior insulation disposed on the outer surface of the inner wythe. Recently, building codes have required that after the anchoring system is installed and, prior to the inner wythe being closed up, that an inspection be made for insulation integrity to ensure that the insulation prevents thermal transfer from the exterior to the interior and from the interior to the exterior. Here the term insulation integrity is used in the same sense as the building code in that, after the installation of the anchoring system, there is no change or interference with the insulative properties and concomitantly substantially no change in the air and moisture infiltration characteristics and substantially no loss of heat or air conditioned air from the interior. The present invention is designed to minimize invasiveness into the insulative layer.

For purposes of this disclosure a cavity wall with a larger-than-normal or high-span cavity is defined as a wall in which the cavity is more than four inches (as measured along a line normal to the surfaces). When such high-span cavities occur, the effect is that stronger joint reinforcements are required in the inner wythe to support the stresses imparted by anchoring the more distant outer wythe or veneer.

Additionally, in a related sense, prior art sheetmetal anchors have formed a conductive bridge between the wall cavity and the metal studs of columns of the interior of the building. Here the terms thermal conductivity, thermally-isolated and -isolating, and thermal conductivity analysis are used to examine this phenomenon and the metal-to-metal contacts across the inner wythe.

Anchoring systems for cavity walls are used to secure veneer facings to a building and overcome seismic and other forces, i.e., wind shear, etc. In the past, some systems have experienced failure because the forces have been concentrated at substantially a single point. Here, the term pin-point loading refers to an anchoring system wherein forces are concentrated as at a single point. In the Description which follows, means for supporting the wall anchor to limit lateral movement are taught.

Figure 5:
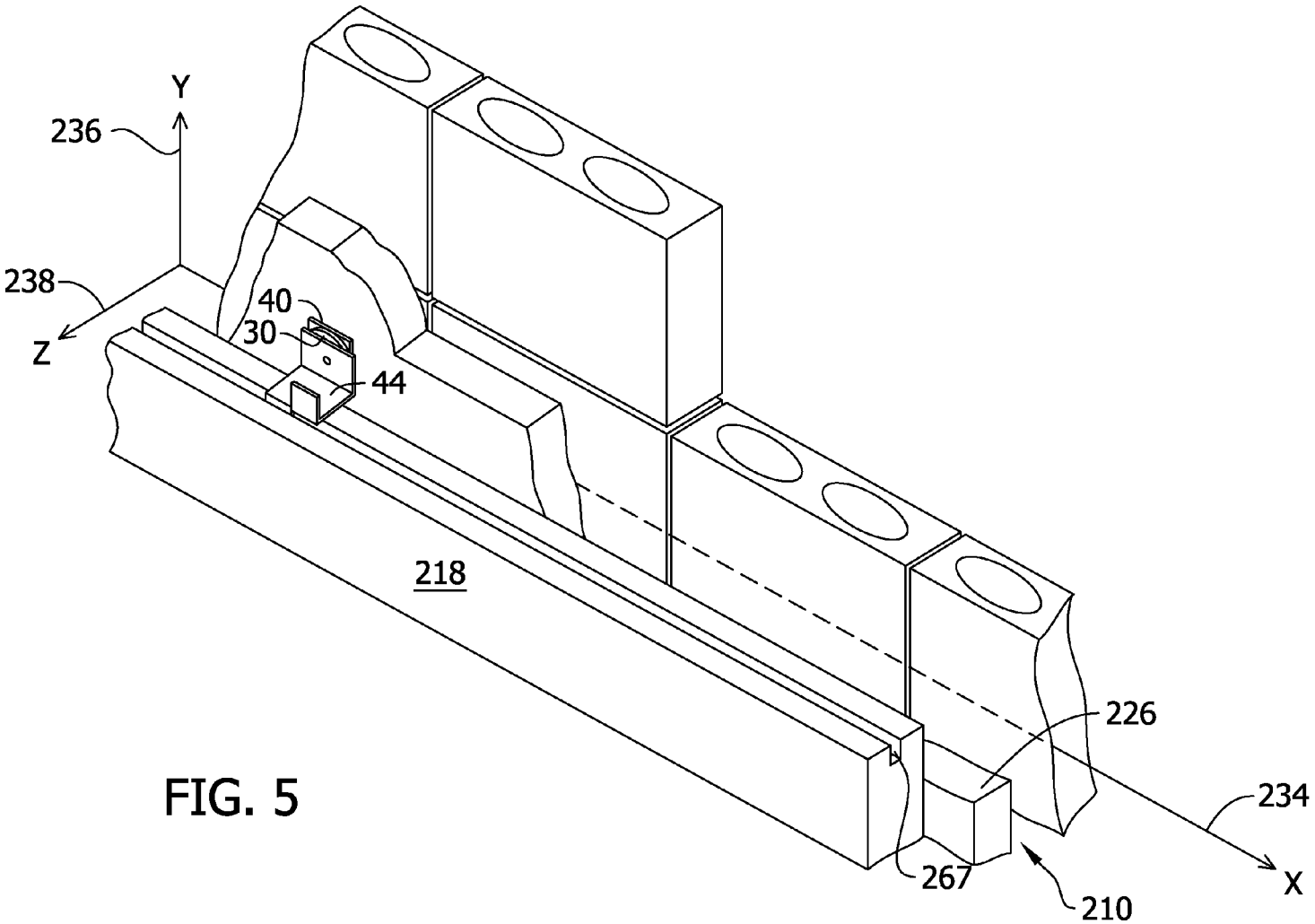
FIG. 5 is a perspective view of a third embodiment of the mounting arrangement for panel veneer structures surface-mounted to a cavity wall with an inner wythe of masonry construction having insulation disposed on the cavity-side thereof.

In the detailed description, the wall anchor is secured to the inner wythe through the use of fasteners or mounting hardware. The wall anchor is either surface mounted onto an externally insulated dry wall inner wythe (as shown in FIG. 1) or installed onto an externally insulated masonry inner wythe (as shown in FIG. 5).

Figure 1:
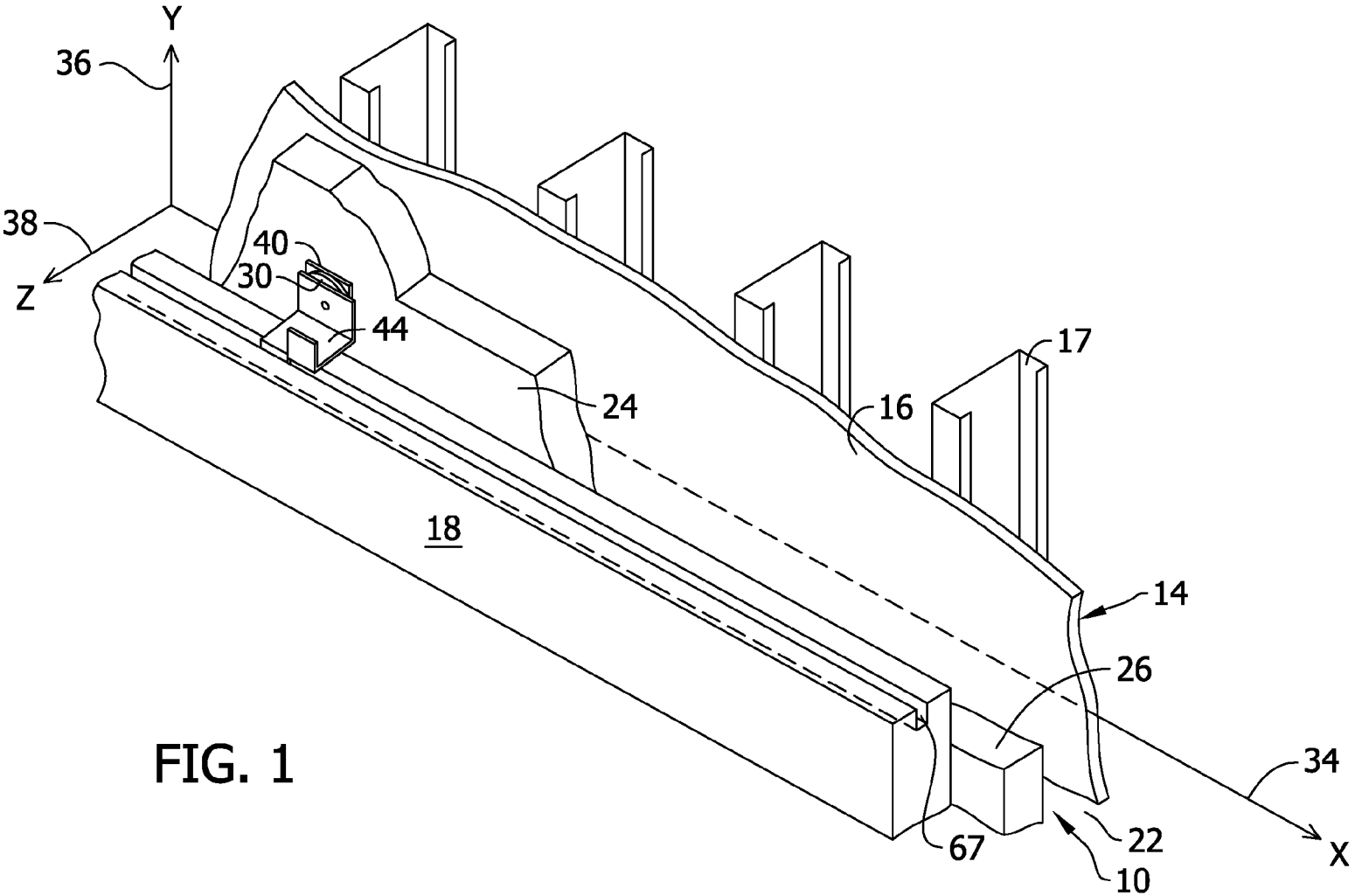
FIG. 1 is a perspective view of a mounting arrangement for panel veneer structures surface-mounted to a cavity wall with an inner wythe of dry wall construction having insulation disposed on the cavity-side thereof.
Figure 2:
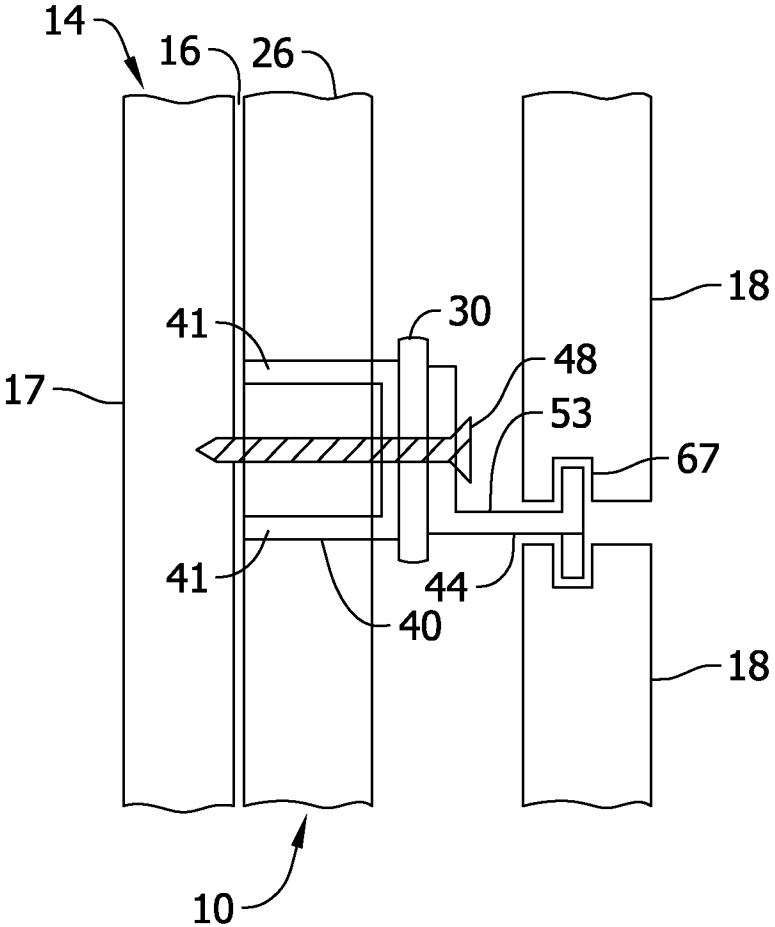
FIG. 2 is cross-sectional view of the mounting arrangement of FIG. 1 with the mounting arrangement interengaged with panel veneers.
Figure 3:
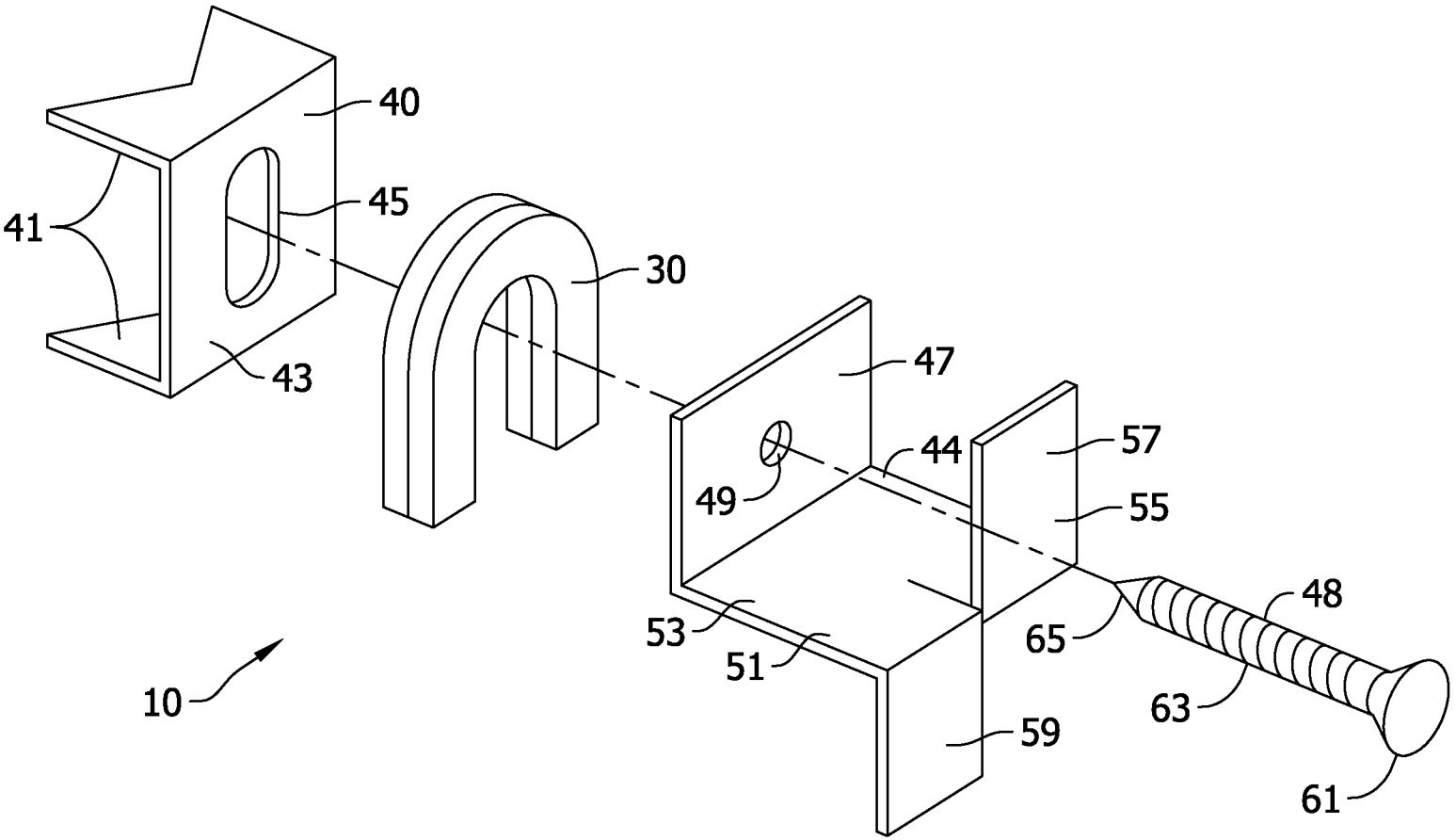
FIG. 3 is an exploded perspective view of the mounting arrangement of FIG. 1.

Referring now to FIGS. 1 through 3, the first embodiment shows a surface-mounted high-strength panel anchoring system for use in a cavity wall. This wall anchor is suitable for recently promulgated standards with more rigorous tension and compression characteristics.

For the first embodiment, the anchoring system is generally referred to by the numeral 10. A cavity wall structure having an inner wythe or dry wall backup 14 with sheetrock or wallboard 16 and insulation 26 mounted on metal studs or columns 17 and an outer wythe of facing panels 18 is shown. Between the inner wythe 14 and the outer wythe 18, a cavity 22 is formed. The insulation 26 layer shown as exemplary is 2-inch rigid insulation.

For purposes of discussion, the cavity surface 24 of the inner wythe 14 contains a horizontal line or x-axis 34 and an intersecting vertical line or y-axis 36. A horizontal line or z-axis 38 also passes through the coordinate origin formed by the intersecting x- and y-axes. A wall anchor 40 which is surface-mounted in the inner wythe 14, is shown which has a separator 30 and an interconnecting veneer tie 44.

The wall anchor 40 has a set of pronged legs 41 connected by a plate 43. The plate 43 maintains the legs 41 at substantially right angles and contains an aperture 45 to receive a fastener 48. The legs 41 are inserted through the insulation 26 and secured against the inner wythe 14. The wall anchor 40 is composed of sheet metal selected from a group consisting of hot dipped galvanized steel, stainless steel, and bright basic steel. Adjacent to the wall anchor 40 is a separator 30. The separator 30 is substantially U-shaped and is placed against the plate 43 so that the aperture 45 remains open and able to receive the fastener or mounting hardware 48. The separator 30 is optimally thermally-isolating and constructed of compressible nonconductive material such as neoprene. This anchoring system maintains insulation integrity and provides thermal isolation.

A split veneer tie 44 is set adjacent the separator and has a backplate 47 with an aperture 49 to receive the fastener 48. The veneer tie 44 is optimally composed of sheet metal. An insertion portion 51 of the veneer tie 44 has a cavity portion 53 contiguous with the backplate 47. The cavity portion 53 is set at a substantially right angle from the backplate 47 and is contiguous with the insertion end 55. The veneer tie 44 insertion end 55 has two legs 57 and 59 set at opposite substantially right angles and dimensioned to interconnect with the panels 18.

A fastener 48 is inserted through the veneer tie 44 aperture 49, the separator 30 and the wall anchor 40 aperture 45 for securement within the inner wythe 14. The fastener 48 contains a fastener head 61 which is dimensioned to be larger than the veneer tie 44 aperture 49. The fastener head 61 is contiguous with the fastener shaft 63 which is then, in turn, contiguous with the fastener tip 65. The fastener 48 is optimally self-drilling or self-tapping. Optionally, a nonconductive washer is inserted between the backplate 47 and the fastener head 61 (not shown). The panels 18 are notched 67 to receive the insertion end legs 57 and 59. Further, the insertion end 55 separates the courses of panels 18 and restrains panels 18 against movement. The insertion end 57 is inserted in the vertically higher panel 18 while the insertion end 59 is inserted in the vertically lower adjacent panel 18 to secure the successive courses of panels 18. The panels 18 are selected from a group that includes stone, composites, polymers and metal but any variations or similar materials are similarly included.

Figure 4:
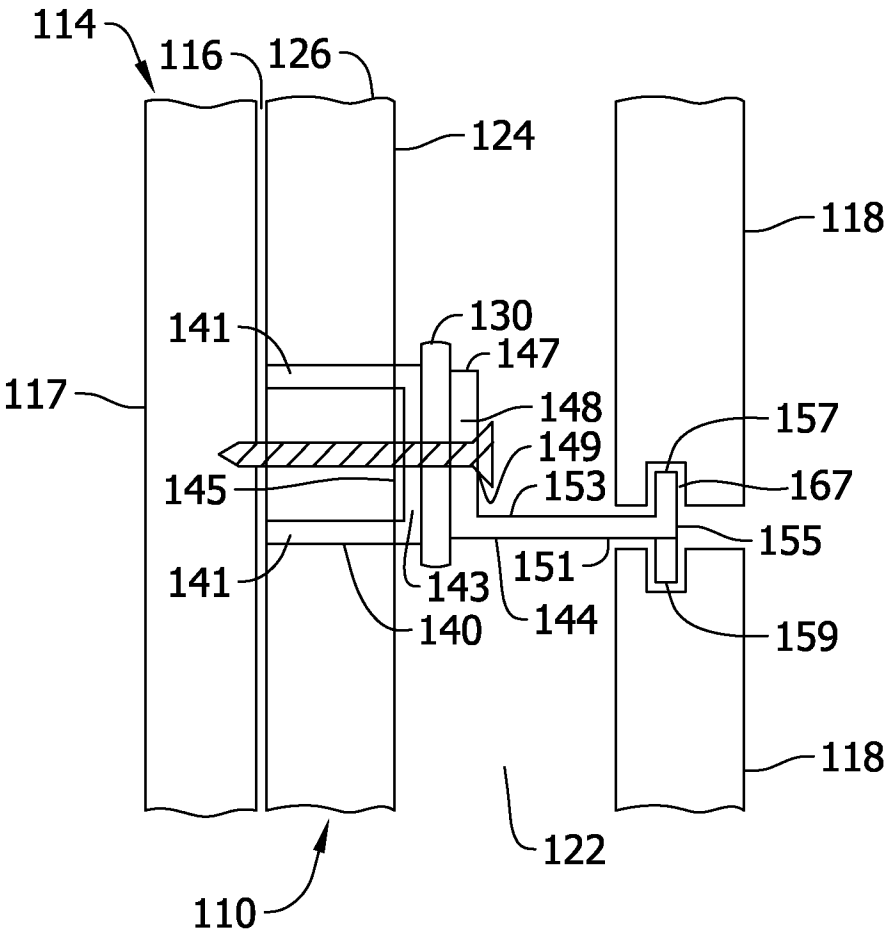
FIG. 4 is a cross-sectional view of a second embodiment of the mounting arrangement for panel veneer structures surface mounted to a cavity wall with an inner wythe of dry wall construction having insulation disposed on the cavity-side thereof. The cavity in this embodiment is a high-span cavity.

The description which follows is a second embodiment of a high-strength panel anchoring system for use in a cavity wall. For ease of comprehension, wherever possible similar parts use reference designators 100 units higher than those in the first embodiment. Thus, the veneer tie 144 of the second embodiment is analogous to the veneer tie 44 of the first embodiment. Referring now to FIG. 4, the second embodiment is shown and is referred to generally by the numeral 110. As in the first embodiment, a wall structure similar to that shown in FIG. 1 is used herein. Optionally, a masonry inner wythe similar to FIG. 5 is used.

FIG. 4 shows a surface-mounted, thermally-isolating anchor assembly for a cavity wall. This anchor is suitable for recently promulgated standards with more rigorous tension and compression characteristics. The system discussed in detail herein below, is a high-strength wall anchor for connection with an interengaging veneer tie. The wall anchor is either surface mounted onto an externally insulated dry wall inner wythe (as shown in FIG. 1) or installed onto an externally insulated masonry inner wythe (as shown in FIG. 5).

For this embodiment, a cavity wall having an insulative layer of 3½ inches (approx.) and a total span of 6 inches (approx.) are chosen as exemplary. This structure meets the R-factor requirements of the public sector building specification. The anchoring system is referred to as high-span and generally referred to by the number 110. The cavity 122 is larger-than-normal and has a 6-inch span. A cavity wall structure having an inner wythe or dry wall backup 114 with sheetrock or wallboard 116 and insulation 126 mounted on metal studs or columns 117 and an outer wythe of facing panels 118 is shown. Between the inner wythe 114 and the outer wythe 118, a cavity 122 is formed. The cavity 122 is larger-than-normal and has a 6-inch span.

For purposes of discussion, the cavity surface 124 of the inner wythe contains a horizontal line or x-axis 34 and an intersecting vertical line or y-axis 36. A horizontal line or z-axis 38 also passes through the coordinate origin formed by the intersecting x- and y-axes. A wall anchor 140 which is surface-mounted in the inner wythe 114 is shown, which has an interconnecting separator 130 and veneer tie 144.

The sheetmetal wall anchor 140 has a set of pronged legs 141 connected by a plate 143. The plate 143 maintains the legs 141 at substantially right angles and contains an elongated slot aperture 145 to receive a fastener 148. The legs 141 are inserted through the insulation 126 and secured against the inner wythe 114. The wall anchor 140 is composed of sheet metal selected from a group consisting of hot dipped galvanized steel, stainless steel, and bright basic steel. Adjacent to the wall anchor 140 is a separator 130. The separator 130 is substantially U-shaped and is placed against the plate 143 so that the aperture 145 remains open and able to receive the fastener or mounting hardware 148. The separator 130 is optimally thermally-isolating and constructed of compressible nonconductive material such as neoprene. This anchoring system maintains insulation integrity and provides thermal isolation.

A split sheetmetal veneer tie 144 is set adjacent the separator 130 and has a backplate 147 with an aperture 149 to receive the fastener 148. An insertion portion 151 of the veneer tie 144 has a cavity portion 153 contiguous with the backplate 147. The cavity portion 153 is set at a substantially right angle from the backplate 147 and is contiguous with the insertion end 155. The veneer tie 144 insertion end 155 has two legs 157 and 159 set at opposite substantially right angles and dimensioned to interconnect with the panels 118.

A fastener 148 is inserted through the veneer tie 144 aperture 149, the separator 130 and the wall anchor 140 aperture 145 for securement within the inner wythe 114. The fastener 148 (as shown more fully in FIG. 3) contains a fastener head 61 which is dimensioned to be larger than the veneer tie 144 aperture 149. The fastener head 61 is contiguous with the fastener shaft 63 which is then, in turn, contiguous with the fastener tip 65. The fastener 148 is optimally self-drilling or self-tapping. Optionally, a nonconductive washer is inserted between the backplate 147 and the fastener head 61 (not shown).

The panels 118 are notched 167 to receive the insertion end legs 157 and 159. Further, the insertion end 155 separates the courses of panels 118 and restrains the panels 118 against movement. The insertion end 157 is inserted in the vertically higher panel 118 while the insertion end 159 is inserted in the vertically lower adjacent panel 118 to secure the successive courses of panels 118. The panels 118 are selected from a group that includes stone, composites, polymers and metal but any variations or similar materials are similarly included.

The description which follows is a third embodiment of thermally-isolating anchoring system for cavity walls. For ease of comprehension, wherever possible similar parts use reference designators 200 units higher than those in the first embodiment. Thus the veneer tie 44 of the first embodiment is analogous to the veneer tie 242 of the third embodiment. Referring now to FIG. 5, the third embodiment is shown and is referred to generally by the numeral 210. As in the first embodiment, a wall anchor structure similar to that shown in FIG. 3 is used herein. Optionally, a dry wall inner wythe as shown in FIG. 5 is used.

For the second embodiment, the anchoring system is generally referred to by the numeral 210. A cavity wall structure having a masonry wall backup or inner wythe 214 with insulation 226 mounted thereon and an outer wythe of facing panels 218 is shown. Between the inner wythe 214 and the outer wythe 218, a cavity 222 is formed. The insulation 226 layer shown as exemplary is 2-inch insulation.

For purposes of discussion, the cavity surface 224 of the inner wythe 214 contains a horizontal line or x-axis 234 and an intersecting vertical line or y-axis 236. A horizontal line or z-axis 238 also passes through the coordinate origin formed by the intersecting x- and y-axes. A wall anchor 40 which is surface-mounted in the inner wythe 214, is shown which has a separator 30 and an interconnecting veneer tie 44.

The wall anchor 40 has a first and a second pronged leg 41 connected by a plate 43. The plate 43 maintains the legs 41 at substantially right angles and contains an aperture 45 to receive a fastener 48. The legs 41 are substantially parallel and inserted through the insulation 226 and secured against the inner wythe 214. The wall anchor 40 is composed of folded sheet metal selected from a group consisting of hot dipped galvanized steel, stainless steel, and bright basic steel. Adjacent to the wall anchor 40 is a separator 30. The separator 30 is substantially U-shaped and is placed against the plate 43 so that the separator 30 straddles the elongated slot aperture 45 and the aperture 45 remains open and able to receive the fastener or mounting hardware 48. The separator 30 is optimally thermally-isolating and constructed of compressible nonconductive material such as neoprene. This anchoring system maintains insulation integrity and provides thermal isolation.

A split veneer tie 44 is set adjacent the separator and has a backplate 47 with an aperture 49 to receive the fastener 48. The veneer tie 44 is optimally composed of sheet metal. An insertion portion 51 of the veneer tie 44 has a cavity portion 53 contiguous with the backplate 47. The cavity portion 53 is set at a substantially right angle from the backplate 47 and is contiguous with the insertion end 55. The veneer tie 44 insertion end 55 has two legs 57 and 59 set at opposite substantially right angles and dimensioned to interconnect with the panels 18.

A fastener 48 is inserted through the veneer tie 44 aperture 49, the separator 30 and the wall anchor 40 aperture 45 for securement within the inner wythe 14. The fastener 48 contains a fastener head 61 which is dimensioned to be larger than the veneer tie 44 aperture 49. The fastener head 61 is contiguous with the fastener shaft 63 which is then, in turn, contiguous with the fastener tip 65. The fastener 48 is optimally self-drilling or self-tapping. Optionally, a nonconductive washer is inserted between the backplate 47 and the fastener head 61 (not shown).

The panels 18 are notched 67 to receive the insertion end legs 57 and 59. Further, the insertion end 55 separates the courses of panels 18 and restrains the panels 18 against movement. The insertion end 57 is inserted in the vertically higher panel 18 while the insertion end 59 is inserted in the vertically lower adjacent panel 18 to secure the successive courses of panels 18. The panels 18 are selected from a group that includes stone, composites, polymers and metal but any variations or similar materials are similarly included.

In the above description of the high-strength panel anchoring system of this invention sets forth various described configurations and applications thereof in corresponding anchoring systems. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength panel anchoring system for use in a cavity wall, said cavity wall having a wallboard inner wythe and insulation thereon and an outer wythe in a spaced apart relationship the one with the other and having a cavity therebetween, said outer wythe being formed from a plurality of panels, said anchoring system comprising:

a wall anchor fixedly attachable to said inner wythe, said wall anchor further comprising:

a set of pronged legs for insertion through said insulation and securement against said inner wythe; and, a plate connecting said set of pronged legs and maintaining said legs at substantially right angles from said plate, said plate having an aperture to receive a fastener;

a separator adjacent said wall anchor, said separator being substantially U-shaped;

a split veneer tie adjacent said separator and opposite said wall anchor, said veneer tie further comprising:

a backplate having an aperture to receive a fastener; and, an insertion portion having a cavity end contiguous with said backplate and set at a substantially right angle from said backplate and an insertion end for interconnection with said panels, said insertion end having two legs set at opposite substantially right angles from said cavity end and dimensioned for interconnection with said panels; and, a fastener for interconnection with said inner wythe.

2. A high-strength panel anchoring system of claim 1, wherein said insertion end legs are configured for insertion into notches in the panels to restrain the panels from lateral movement.

3. A high-strength panel anchoring system of claim 2, wherein the wall anchor, separator, and veneer tie are configured for use with panels selected from a group consisting of stone, composites, polymers, and metal.

4. A high-strength panel anchoring system of claim 3, wherein said separator is thermally-isolating and constructed of compressible nonconductive material.

5. A high-strength panel anchoring system of claim 1, wherein said fastener further comprises:

a fastener head dimensioned to be larger than said backplate aperture;

a fastener shaft contiguous with said fastener head; and, a fastener tip contiguous with said fastener shaft and opposite said fastener head.

6. A high-strength panel anchoring system of claim 5, wherein said fastener is self-tapping.

7. A high-strength panel anchoring system of claim 1, wherein said veneer tie and anchor are formed from sheetmetal selected from the group consisting of hot dipped galvanized steel, stainless steel and bright basic steel.

8. A high-strength panel anchoring system as set forth in claim 1, wherein the separator is constructed for fitting between and engaging both the wall anchor and the veneer tie to form a thermal barrier between the wall anchor and the veneer tie.

9. A high-strength panel anchoring system for use in a high-span cavity wall, said cavity wall having a wallboard inner wythe and insulation thereon and an outer wythe in a spaced apart relationship the one with the other and having a cavity in excess of four inches therebetween, said outer wythe formed from a plurality of panels, said anchoring system comprising:

a sheetmetal wall anchor fixedly attachable to said inner wythe, said wall anchor further comprising:

a set of pronged legs for insertion through said insulation and securement against said inner wythe; and, a plate connecting said set of pronged legs and maintaining said legs at substantially right angles from said plate, said plate having an aperture to receive a fastener, said aperture being an elongated slot;

a separator adjacent said wall anchor, said separator substantially U-shaped;

a split sheetmetal veneer tie adjacent said separator and opposite said wall anchor, said veneer tie further comprising:

a backplate having an aperture to receive a fastener; and, an insertion portion having a cavity end contiguous with said backplate and set at a substantially right angle from said backplate and an insertion end for interconnection with said panels, said insertion end having two legs set at opposite substantially right angles from said cavity end and dimensioned for interconnection with said panels, said veneer tie dimensioned to limit movement of the outer wythe; and, a fastener for interconnection with said inner wythe.

10. A high-strength panel anchoring system of claim 9, wherein said insertion end legs are configured for insertion into notches in the panels to restrain the panels from lateral movement.

11. A high-strength panel anchoring system of claim 10, wherein the wall anchor, separator, and veneer tie are configured for use with panels selected from a group consisting of stone, composites, polymers, and metal.

12. A high-strength panel anchoring system of claim 11, wherein said separator is thermally-isolating and constructed of compressible nonconductive material.

13. A high-strength panel anchoring system of claim 9, wherein said fastener further comprises:

a fastener head dimensioned to be larger than said backplate aperture;

a fastener shaft contiguous with said fastener head; and, a fastener tip contiguous with said fastener shaft and opposite said fastener head.

14. A high-strength panel anchoring system of claim 13, wherein said anchoring system is configured for use with insulation is over three inches thick.

15. A high-strength panel anchoring system of claim 9, wherein said veneer tie and anchor are formed from a material selected from the group consisting of hot dipped galvanized steel, stainless steel and bright basic steel.

16. A high-strength panel anchoring system as set forth in claim 9, wherein the separator is constructed for fitting between and engaging both the wall anchor and the veneer tie to form a thermal barrier between the wall anchor and the veneer tie.

17. A high-strength panel anchoring system for use in a cavity wall, said cavity wall having a masonry inner wythe and insulation thereon and an outer wythe in a spaced apart relationship the one with the other and having a cavity therebetween, said outer wythe formed from a plurality of panels, said anchoring system comprising:

a folded sheetmetal wall anchor fixedly attachable to said inner wythe, said wall anchor further comprising:

a first pronged leg for insertion through said insulation and securement against said inner wythe;

a second pronged leg for insertion through said insulation and securement against said inner wythe, said second pronged leg being substantially parallel to said first pronged leg; and, an apertured plate set at a substantially right angle from said first pronged leg and said second pronged leg, said plate joining said first pronged leg and said second pronged leg, said aperture being an elongated slot;

a thermally-isolating separator set adjacent said wall anchor, said separator being substantially U-shaped and dimensioned to straddle said aperture;

a split sheetmetal veneer tie adjacent said separator and opposite said wall anchor, said veneer tie further comprising:

a backplate having an aperture to receive a fastener; and, an insertion portion having a cavity end contiguous with said backplate and set at a substantially right angle from said backplate and an insertion end for interconnection with said panels, said insertion end having two legs set at opposite substantially right angles from said cavity end and dimensioned for interconnection with said panels, said veneer tie being dimensioned to limit movement of the outer wythe; and, a fastener for interconnection with said inner wythe.

18. A high-strength panel anchoring system of claim 17, wherein said insertion end legs are configured for insertion into notches in the panels to restrain the panels from lateral movement.

19. A high-strength panel anchoring system of claim 18, wherein the anchoring system is configured for use with panels selected from a group consisting of stone, composites, polymers, and metal.

20. A high-strength panel anchoring system of claim 19, wherein said separator is constructed of compressible non-conductive material.

21. A high-strength panel anchoring system of claim 17, wherein said fastener further comprises:

a fastener head dimensioned to be larger than said backplate aperture;

a fastener shaft contiguous with said fastener head; and, a fastener tip contiguous with said fastener shaft and opposite said fastener head.

22. A high-strength panel anchoring system of claim 17, wherein said veneer tie and anchor are formed from a material selected from the group consisting of hot dipped galvanized steel, stainless steel and bright basic steel.

23. A high-strength panel anchoring system as set forth in claim 17, wherein the separator is constructed for fitting between and engaging both the wall anchor and the veneer tie to form a thermal barrier between the wall anchor and the veneer tie.

* * * * *

UNITED STATES PATENT AND TRADEMARK OFFICE

CERTIFICATE OF CORRECTION

PATENT NO. : 8,839,587 B2
APPLICATION NO. : 13/798722
DATED : September 23, 2014
INVENTOR(S) : Ronald P. Hohmann, Jr.

It is certified that error appears in the above-identified patent and that said Letters Patent is hereby corrected as shown below:

In the claims

Column 8, Claim 14, Line 36:
"is" before "over three inches" should be deleted.

Signed and Sealed this
Twenty-ninth Day of March, 2016

Michelle K. Lee

Michelle K. Lee
*Director of the United States Patent and Trademark Office*